United States Patent [19]

Fay

[11] Patent Number: 4,779,740

[45] Date of Patent: Oct. 25, 1988

[54] PARTICLE SEPARATING APPARATUS

[76] Inventor: Clinton Fay, Box 98, Port Wing, Wis. 54865

[21] Appl. No.: 84,409

[22] Filed: Aug. 10, 1987

[51] Int. Cl.[4] ..... B07C 5/00

[52] U.S. Cl. ..... 209/642; 209/638; 239/248; 239/688

[58] Field of Search ..... 209/638, 642, 637, 908, 209/910, 911, 145; 239/222, 248, 380, 214, 687, 688; 222/239, 342, 370

[56] References Cited

U.S. PATENT DOCUMENTS

| | | | |
|---|---|---|---|
| 80,764 | 8/1868 | Pearce | 209/642 |
| 87,360 | 3/1869 | Pearce | 209/642 |
| 466,730 | 1/1892 | Vellines | 209/642 |
| 478,828 | 7/1892 | Sundgren | 209/642 |
| 653,792 | 7/1900 | Dasconaguerre | 209/642 |
| 728,475 | 5/1903 | Lane | 209/153 |
| 833,704 | 10/1906 | Whipple et al. | 239/238 |
| 895,489 | 8/1908 | Morse | 222/239 |
| 942,251 | 12/1909 | Ernst | 209/145 |
| 976,350 | 11/1910 | Enrsam et al. | 209/642 |
| 1,358,375 | 11/1920 | Koch | 209/145 |
| 1,461,777 | 7/1923 | Koch | 209/145 |
| 3,520,407 | 7/1970 | Rumpf | 209/139 |
| 3,620,390 | 11/1971 | McKinnon | 239/687 |
| 3,969,224 | 7/1976 | Cerbo | 209/638 |
| 4,437,613 | 3/1984 | Olson | 239/688 |

FOREIGN PATENT DOCUMENTS

| | | | |
|---|---|---|---|
| 2757994 | 1/1954 | United Kingdom | 209/642 |

*Primary Examiner*—Robert B. Reeves
*Assistant Examiner*—Donald T. Hajec
*Attorney, Agent, or Firm*—Merchant, Gould, Smith, Edell, Welter & Schmidt

[57] ABSTRACT

A particle separating apparatus is disclosed comprising a particle container. The particle container has an interior wall which defines a particle receiving chamber. The container has an opening exposing the chamber. The container is mounted to rotate about an axis generally coaxial with an axis of the opening. A conduit is provided for admitting a flow of particulate matter into the chamber through the opening. A plurality of apertures extend generally radially from the interior and through the container. Stabilizing mechanisms in the form of stabilizer blades are provided within the chamber with cushioned edges disposed closely adjacent to the interior wall with the edges extending generally parallel to the axis of rotation. A lifting mechanism is disposed within the chamber having lifting plates disposed to rotate within the chamber and urge particulate material from a closed end of the chamber toward the opening and promote uniform distribution axially within the interior of the container.

11 Claims, 3 Drawing Sheets

PARTICLE SEPARATING APPARATUS

BACKGROUND OF THE INVENTION

I. Field of the Invention

This invention relates to apparatus for separating particulate matter. More particularly, this invention pertains to apparatus for centrifugally separating particulate matter.

II. Description of the Prior Art

Frequently, it is desirable to separate particulate matter based on mass. One means of performing such separation is through centrifugal separation. An example of such a separating apparatus is shown in U.S. Pat. No. 3,969,224 to Cerbo dated July 13, 1976.

Centrifugal separation of particulate matter will be desirable in numerous instances. For example, in mineral processing, valuable minerals frequently have a specific gravity greater than a specific gravity of the ore material with which the mineral is associated. By crushing the ore and mineral into generally uniform size, the ore and mineral may be separated through centrifugal separation. Centrifugal separation is particularly useful in such mineral processing since centrifugal separation can frequently be used as a dry process. This has particular advantages for uses in regions where water is scarce.

A very important use of centrifugal processing would be in separating grains from waste material. In the Fall, centrifugal separators can be used to clean away the lighter fine material. In Spring, such separators can be used to separate the best kernels which are usually heavier than lesser grade kernels. The heavier kernels are a preferred seed.

It is an object of the present to provide a centrifugal separator apparatus which can be used for a wide variety of particulate separation. Further, it is an object of the present invention to provide such an apparatus which may be used with particulate material which is susceptible to caking. It is also an object of the present invention to overcome problems encountered with prior art centrifugal separators. Namely, previous attempts to separate particulates using centrifugal force have been inefficient and impractical since the centrifugal force within the dispersion chamber results in the bridging of the particulate material across the apertures.

SUMMARY OF THE INVENTION

According to a preferred embodiment of the present invention, there is provided a particle separating apparatus which includes a particle container having an interior wall which defines a particle receiving chamber. The container has an opening which exposes the chamber. The container is mounted to rotate about an axis generally coaxial with the axis of the chamber opening. A conduit is provided for admitting a flow of particulate matter into the chamber through the opening. A plurality of apertures are formed through the container in particulate flow communication with the chamber. The apertures extend generally radially from the axis of rotation. Separating apparatus includes stabilizing means disposed within the chamber for preventing the rotation of the particulate matter as the container rotates.

DESCRIPTION OF THE PREFERRED EMBODIMENT

Referring now to the several drawing figures in which similar parts are identically numbered throughout, the present invention and its operation will now be described.

Figure 1:
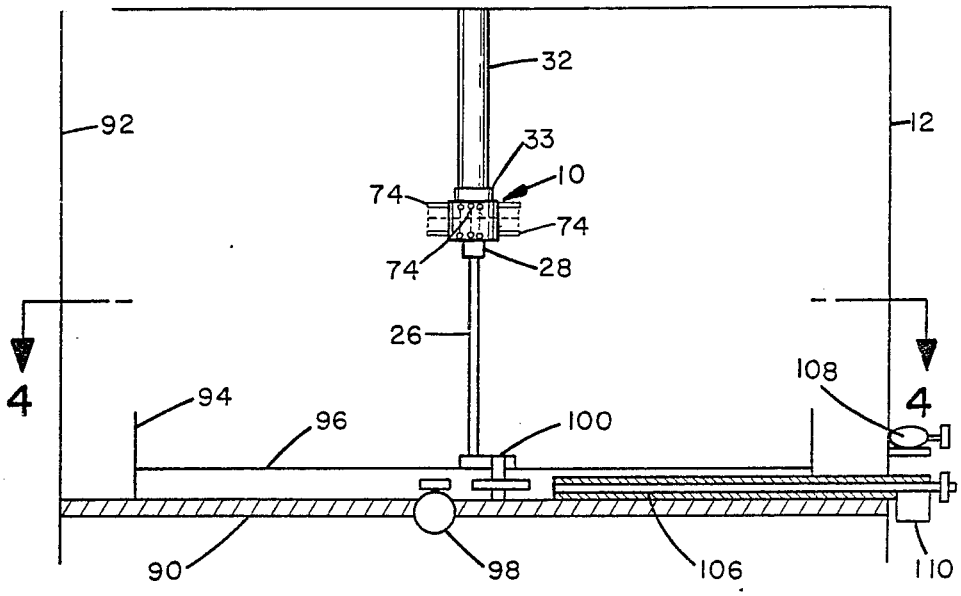
FIG. 1 is a sectional view taken in elevation of a separating apparatus according to the present invention.

FIG. 1 shows the present invention for use in a preferred embodiment for the separation of grain from fines and lesser weight grains. The separating apparatus is shown generally at 10 and is enclosed within a housing 12. It will be appreciated the present invention operates most effectively when in an enclosed space such as provided by housing 12. Such a location eliminates moving air which will interfere with the separation principles of the invention.

Figure 2:
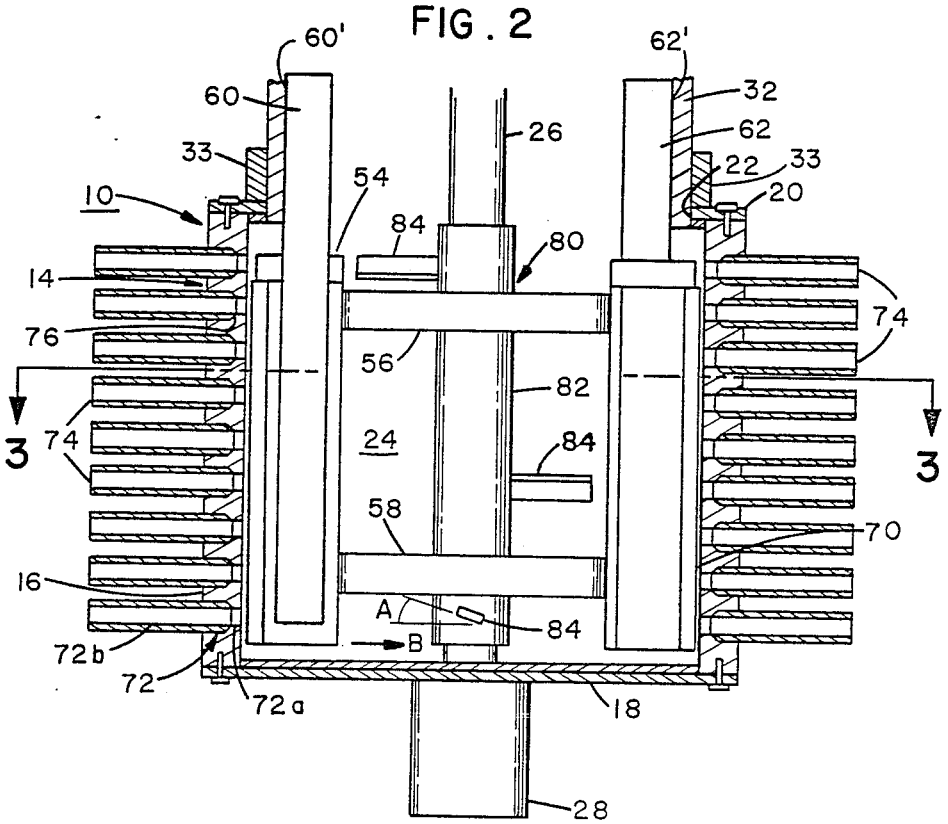
FIG. 2 is an enlarged elevation view taken in section of a particle container and associated apparatus of the present invention.

Best shown in FIG. 2, the apparatus 10 includes a particle container 14 which is cylindrical in shape. The container 14 comprises a cylindrical container wall 16 having one axially face closed by a bottom plate 18. A second axial face of the cylindrical container wall 16 includes a top ring 20 which leaves the majority of the second axial face uncovered to define an opening 22 in communication with the container interior 24.

A drive shaft 26 is provided with its axis vertically disposed. Shaft 26 is rotatable about its axis.

Container 14 is connected to shaft 26 with an axis of the container being coaxial with the axis of the shaft 26 and with container 14 being freely rotatable with shaft 26. The container 14 is connected to shaft 26 by means of a connecting hub 28. Shaft 26 extends through hub 28 as shown in the figures. The axial positioning of container 14 on shaft 26 may be adjusted through any suitable means (not shown).

The apparatus includes a feed tube 32 which is cylindrical and sized with an exterior diameter being approximately equal to an interior diameter of top ring 20. Feed tube 32 extends surrounding the upper portion of drive shaft 26 with tube 32 extending into the opening 22 of container 14. Accordingly, feed tube 32 is in particulate flow communication with the interior 24 of container 14.

A feed tube support ring 33 is fixed to the outer surface of tube 32 and positioned to abut ring 20 when tube 32 extends into opening 22. Support ring 33 prevents inadvertent downward movement of tube 32 ino container 14.

Figure 7:
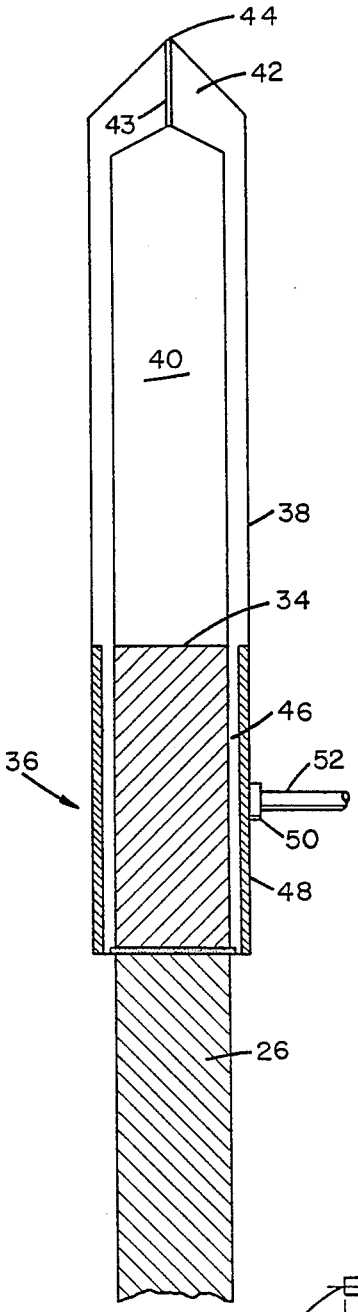
FIG. 7 is an enlarged view of the support detail of FIG. 5.
Figure 5:
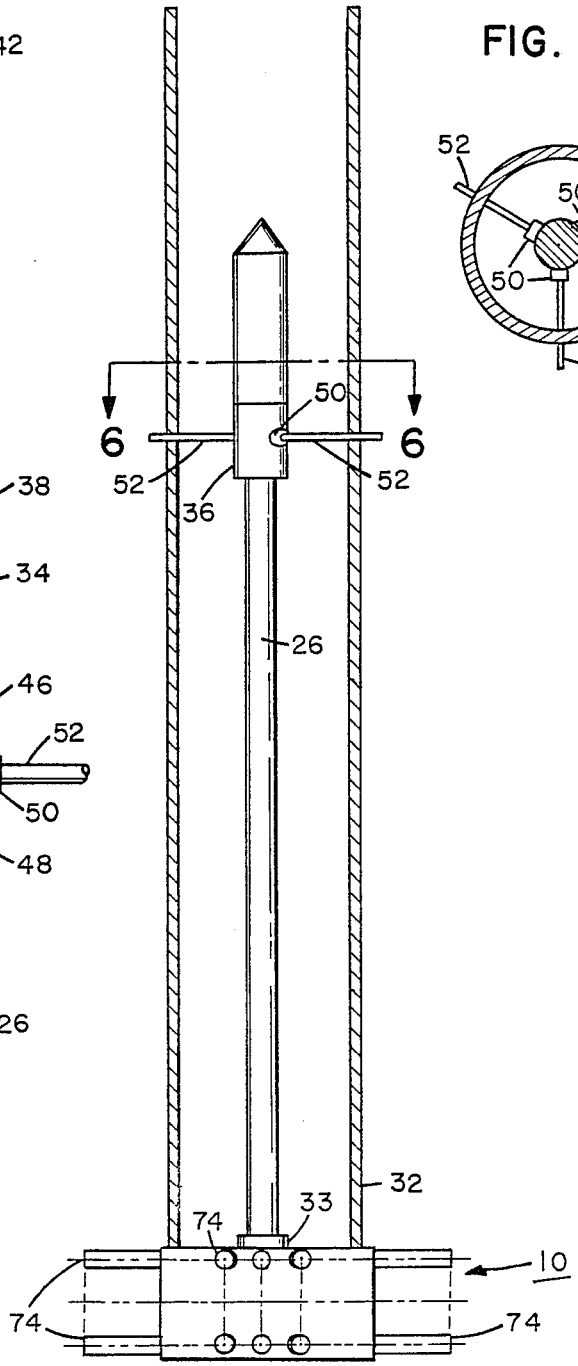
FIG. 5 is a view showing a feed tube support bearing structure for use with the present invention.
Figure 6:
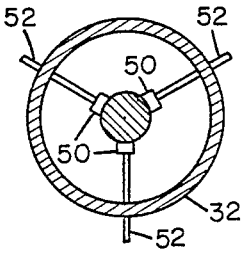
FIG. 6 is a view taken along line 6—6 of FIG. 5.

Shown best in FIGS. 5–7, an upper end 34 of shaft 26 is supported by feed tube 32. A shaft end bearing 36 includes a hollow rod 38 sized to rotatably receive shaft end 34 within an interior 40 of rod 38. An upper end 42 of rod 38 is closed and includes an axially extending bore 43 which may be closed by a grease fitting (not shown). Lubricating grease may be injected through bore 43 into interior 40 to lubricate rotating shaft end 34.

A lower end 46 of rod 38 is surrounded by a sleeve 48. Preferably sleeve 48 is metal and includes a plurality of anchor nuts 50 secured to sleeve 46 through any suitable means such as welding. Support bolts 52 are threadably received on nuts 50 and extend radially from sleeve 48 through feed tube 32 (FIG. 6). The bolts 52 are connected to feed tube 32 in any suitable manner to thereby retain the upper end 34 of drive shaft 26 in axial alignment with feed tube 32.

Figure 3:
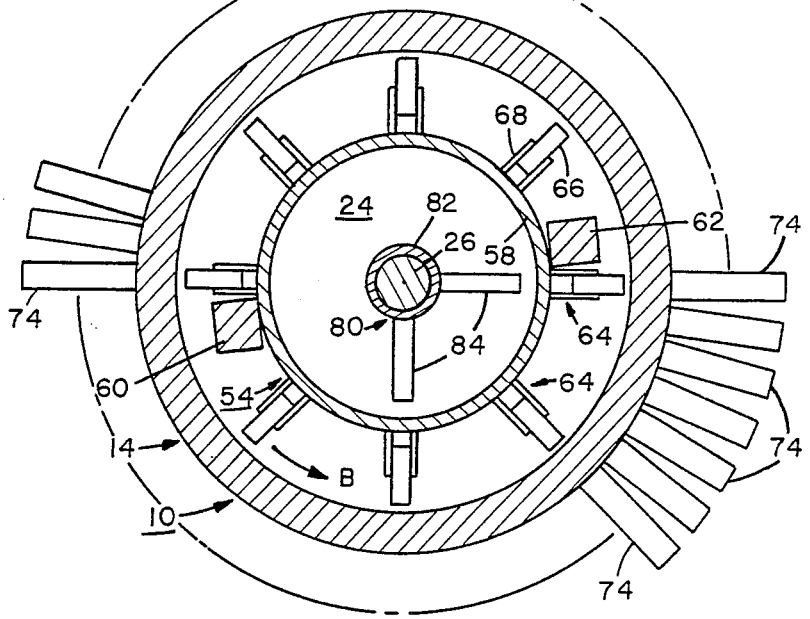
FIG. 3 is a view taken along line 3—3 of FIG. 2.

Shown best in FIGS. 2 and 3, feed stabilizer 54 is disposed within the interior 24 of container 14. Stabilizer 54 includes a pair of parallel axially displaced support rings 56 and 58. Support rings 56 and 58 are maintained in spaced apart axial alignment by means of a plurality of stabilizer blades 64. The stabilizer blades 64 constitute blocking walls extending generally transverse to a direction of rotation of the container 14. The container 14 is movable relative to the blades or walls.

Stabilizer blades 64 are secured to the support rings 56 and 58. In a preferred embodiment eight blades 64 are provided although a greater or lesser number could be provided. Each of blades 64 are identical and comprise a resilient or cushion 66 connected to a rigid cushion support 68. The supports 68 are each connected to each of support rings 56 and 58.

As shown in the figures, blades 64 are elongated members and are secured to support rings 56 and 58 with a longitudinal axis of the blades 64 extending generally parallel to the axis of rotation of shaft 26. The blade cushions 66 project generally radially away from the axis of rotation and terminate at a cushion edge 70 which is opposing and closely spaced from an interior surface of cylinder 16. The cushion 66 may be made of any non-abrasive material that will serve to prevent particulate matter from rotating within the container 14 while preventing marring of the interior surface of container 14.

A pair of support bars 60, 62 are provided having radially outer surfaces 60', 62' which oppose the inner surface of feed tube 32. Surfaces 60', 62' are spaced apart approximate the diameter of tube 32. Surfaces 60', 62' are securely connected through any suitable means to tube 32. Accordingly, bars 60, 62 permit stabilizer 54 to float without rotation within container 14.

A plurality of apertures 72 are formed through cylindrical container wall 16. Each of apertures 72 includes a narrow portion 72*a* in direct communication with container interior 24 and an enlarged counter sunk portion 72*b* opening through an exterior of container wall 16. Within each of apertures 72 an elongated barrel 74 is provided. The barrel 74 has an attachment end 76 which is beveled to be received within counter sunk portion 72*b*. The diameters of the barrel 74, and apertures 72 are selected such that an interior diameter of barrel 74 is equal to an interior diameter of aperture portions 72*a* with aperture portions 72*a* and barrel 76 being axially aligned to provide a continuous smooth surface between barrel 74 and aperture portions 72*a*.

The actual number of barrels 74, their spacing and size will vary with material to be separated and with the diameter of the particle chamber. Also, the positioning of the barrels is such that each barrel has a unique radial coordinate in relation to the central axis of rotation. The vertical distance between the rows of barrels 74 may differ from the horizontal spacing between barrels 74 in the same row as a result of achieving optimum positioning. However, once the positioning has been determined, the vertical spacing of all rows of barrels 74 will be uniform and each barrel 74 in each row will be equidistant from the next. For example, container 14 may be provided with nine rows of barrels 74 each extending radially from container 16. In this case, each row would consist of forty barrels with adjacent barrels in the same row being angularly displaced by nine degrees. Barrels in contiguous rows will be angularly offset to achieve unique positioning such that the plurality of barrels 74 will provide a maximum unencumbered distribution of particulate material as will be described. Also, the length of barrels 74 may vary with axial positioning on container 14. For example, the barrel length may decrease from the bottom of container 14 to the top to insure even distribution of material.

The separating apparatus 10 includes a compaction lifter component 80. Lifter component 80 includes a sleeve 82 secured to shaft 26 within the interior 24 of container 14. Sleeve 82 is connected to shaft 26 for rotation therewith. A plurality of compaction lift plates 84 are connected to sleeve 82 for rotation therewith and extend radially away from sleeve 82. Each of lift plates 84 are connected to sleeve 82 and set at an angle A to a line of travel (arrow B) of the lift plates 84 as they rotate with shaft 82. As shown in the figures, the lift plates 84 are disposed within interior 24 in a helical pattern surrounding sleeve 82.

Figure 4:
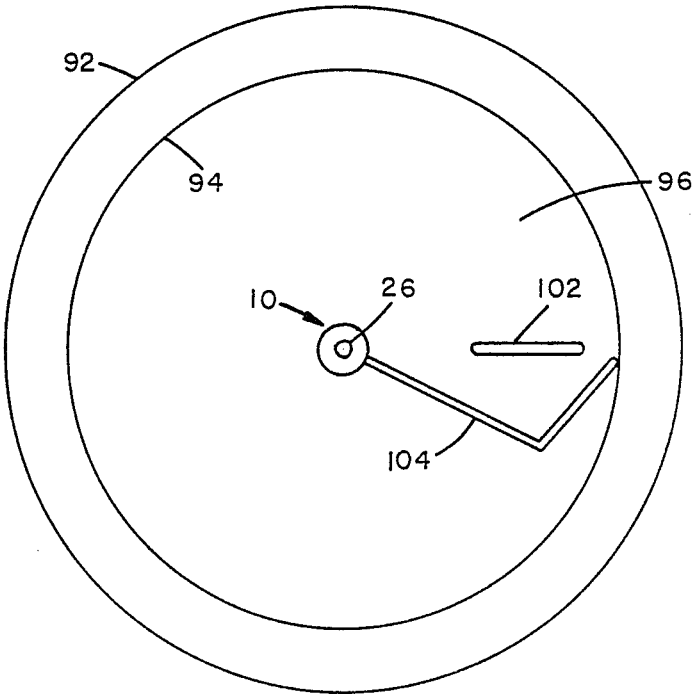
FIG. 4 is a view taken along line 4—4 of FIG. 1.

Referring to FIGS. 1 and 4, a separating apparatus is schematically shown and includes the apparatus 10, feed tube 32 and shaft 26 are disposed within a housing 12. The housing eliminates moving air which would otherwise interfere with separation. Use of the apparatus without a housing should include other efforts to minimize wind. The housing includes a main floor 90 and a cylindrical wall 92. Concentrically surrounding shaft 26 is a separating wall 94 extending upwardly from main floor 90. Spaced above main floor 90 and extending between opposing surfaces of separating wall 94 is a waste floor 96. A drive motor 98 is carried on main floor 90 beneath waste floor 96 and is operably connected to shaft 26 by means of gear reduction box 100.

Waste floor 96 includes a discharge opening 102 which is elongated and extends generally radial to the axis of shaft 26. A sweeper blade 104 is provided for traveling about waste floor 96 and urging particulate matter towards floor discharge opening 102. Disposed beneath floor discharge opening 102 is an auger 106 having a drive motor 108 for driving auger 106 to collect material from floor discharge opening 102 and dispose of the collected material through auger outlet 110. In an embodiment for grain separation, auger 106 is preferred. For use with minerals, auger 106 may be replaced with any conveyor mechanism.

In operation of the apparatus, drive motor 98 through gear reduction box 100 drives shaft 26 to rotate about a vertical axis. Particulate feed material (such as grain to be separated) is admitted through feed tube 32 into the interior 24 of container 14. Container 14 is connected to shaft 26 and rotates therewith. Due to the rotation of container 14, particulate matter within the interior 24 is urged through the plurality of barrels 74 to be thrown radially away from the axis of shaft 26. The distance material travels will be a function of a balance of the weight of the material, air resistance, the vertical height of container 14 and speed of rotation of container 14.

By adjusting the axial positioning of container 14 on shaft 26 and by selecting a desired rotational velocity of shaft 26, material separation is accomplished with wall 94 acting as a dividing wall between material of different weight. Material is collected on floor 96 and is swept by sweeper blade 104 through discharge opening 102. This material is collected by the auger 106 and discharged through auger discharge 110.

Due to support bars 60, 62 being connected to stationary feed tube 32, the plurality of blades 64 are held stationary within rotating container 14. By preventing particulate matter from rotating with the container 14, the stabilizing action prevents material bridging over aperture portions 32, eliminates excessive stress on the walls of container 14 caused by the pressure of unwanted centrifugal movement of the particulate matter, and ensures maximum uniform distribution of particulate material through each of the plurality of barrel 74. To prevent compaction, the rotating compaction sleeve 82 causes rotation of the compaction lift plates 84. The angular disposition of the compaction lift plates 84 on shaft 82 prevents compaction of feed material on bottom plate 18 and urges feed material to be uniformly distributed axially within the interior 24 of container 14. Accordingly, the lift plates assure axial uniformity. The blade mechanisms 64 prevent rotation of the feed material within interior 24 until the feed material is in the barrels 74 and assure that none of the barrels 74 are blocked by bridging of feed material.

The foregoing described apparatus can be used for a variety of separation applications. For example, the apparatus can be used to separate desired grains from waste fines. The desired grain, being more massive than the fines, will be projected furthest from the axis of rotation. Also, in the spring, the feed material may be in the nature of various grains with the heaviest material being generally recognized as those grains which make more desirable seeds. It is further anticipated that the present invention could be useful in mineral separation such as for separating heavy minerals (such as gold and the like) from their lighter weight carrying ores. The apparatus has particular suitability for such mineral separation in that water is not necessary for the process.

From the foregoing detailed description of the present invention, it has been shown how the invention has been attained in a preferred manner. However, modifications and equivalence of the disclosed concepts such as readily occur to those skilled in the art are intended to be included in the scope of this invention. Thus, the scope of the invention is intended to be limited only by the scope of the claims as are, or may hereafter be, appende hereto.

I claim:

1. A particle separating apparatus comprising:

a particle container having an interior wall defining a particle receiving chamber, said container having an opening exposing said chamber;

mounting means for mounting said container to rotate about an axis generally coaxial with an axis of said opening;

conduit means for admitting a flow of particulate matter into said chamber through said opening;

means for defining a plurality of apertures extending generally radially through said wall with each of said apertures in particulate flow communication with said chamber; and stabilizing means for abating rotational movement of particulate matter within said container as said container rotates, said stabilizing means including blocking walls extending generally transverse to a direction of rotation of said container, said container being movable relative to the blocking walls.

2. An apparatus according to claim 1 wherein said blocking walls include a plurality of stabilizer walls with means for supporting said walls within said chamber with said blades opposing and closely spaced from said interior wall.

3. An apparatus according to claim 2 wherein said walls have a longitudinal dimension extending generally parallel to said axis of rotation.

4. An apparatus according to claim 1 wherein said stabilizing means comprise a plurality of resilient walls disposed with longitudinal axes parallel to said axis of rotation and with said walls closely spaced from said interior wall.

5. A particle separating apparatus comprising:

a particle container having an interior wall defining a particle receiving chamber, said container having an opening exposing said chamber;

mounting means for mounting said container to rotate about an axis genrally coaxial with an axis of said opening;

conduit means for admitting a flow of particulate matter into said chamber through said opening;

means for defining a plurality of apertures extending generally radially through said wall with each of said apertures in particulate flow communication with said interior;

stabilizing means for abating rotational movement of particulate matter within said container as said container rotates; and lifting means rotatably disposed within said chamber to lift particulate material away from a bottom portion of said chamber and urge said material axially away from said bottom portion.

6. An apparatus according to claim 5 wherein said lifting means includes a plurality of spaced apart lifting plates radially extending from a shaft disposed within said chamber.

7. An apparatus according to claim 1 wherein said separator is disposed within a housing having a floor with a dividing wall separating said floor into an outer circumferential portion and an inner concentric circumferential portion, a discharge opening formed through said floor in said inner circumferential portion and a moving blade disposed to urge particulate material within said inner portion toward said opening in said floor.

8. A particle separating apparatus comprising:

a container having cylindrical interior wall defining a chamber with an opening generally coaxial with a cylindrical axis of said interior wall;

a rotary shaft disposed for rotation about a generally vertical axis of rotation;

connecting means for connecting said container to said shaft with said cylindrical axis being coaxial with said axis of rotation and with said opening disposed facing upwardly;

a stationary feed tube having a free end disposed to direct a flow of particulate matter from said tube into said chamber through said opening;

a plurality of apertures formed through said container and extending generally radial to said axis of rotation;

a plurality of stabilizer blades disposed within said chamber with said blades having longitudinal dimensions generally parallel to said axis of rotation, said blades having edges disposed closely adjacent said interior wall, said blades extending generally transverse to a direction of rotation of said container, said container being movable relative to said blades

9. An apparatus according to claim 8 wherein said blades include a plurality of brushes disposed within said chamber having longitudinal dimensions extending generally parallel to said axis of rotation with brushes projecting radially toward said interior wall.

10. A particle separating apparatus comprising:

a container having a cylindrical interior wall defining a chamber with an opening generally coaxial with a cylindrical axis of said interior wall;

a rotary shaft disposed for rotation about a generally vertical axis of rotation;

connecting means for connecting said container to said shaft with said cylindrical axis being coaxial with said axis of rotation and with said opening disposed facing upwardly;

a stationary feed tube having a free end disposed to direct a flow of particulate matter from said tube into said chamber through said opening;

a plurality of apertures formed through said container and extending generally radial to said axis of rotation;

a plurality of stabilizer blades disposed within said chamber with said blades having longitudinal dimensions generally parallel to said axis of rotation, said blades having edges disposed closely adjacent said interior wall; and lifting means disposed within said chamber for urging particulate material from a bottom of said chamber and axially upwardly from said bottom of said chamber.

11. An apparatus according to claim 10 wherein said lifting means comprises a rotary shaft disposed within said chamber to rotate coaxially with said axis of rotation, said shaft carrying a plurality of lifting members extending radially from said shaft and disposed in a helical format axially along a length of said shaft.

* * * * *